US006912827B2

(12) United States Patent
Forbes

(10) Patent No.: US 6,912,827 B2
(45) Date of Patent: Jul. 5, 2005

(54) APPARATUS FOR OPENING ENVELOPES

(75) Inventor: John R. Forbes, Media, PA (US)

(73) Assignee: Opex Corporation, Moorestown, NJ (US)

( * ) Notice: Subject to any disclaimer, the term of this patent is extended or adjusted under 35 U.S.C. 154(b) by 53 days.

(21) Appl. No.: 10/093,871

(22) Filed: Mar. 8, 2002

(65) Prior Publication Data

US 2003/0041561 A1 Mar. 6, 2003

Related U.S. Application Data

(60) Provisional application No. 60/317,065, filed on Sep. 4, 2001.

(51) Int. Cl.[7] ..... B31B 49/00

(52) U.S. Cl. ..... 53/381.3; 493/8; 493/34; 83/912; 83/446

(58) Field of Search ..... 53/381.3, 381.5; 85/912, 875–878, 440, 440.1, 446, 447; 493/8–29, 34

(56) References Cited

U.S. PATENT DOCUMENTS

| | | | | |
|---|---|---|---|---|
| 2,368,519 A | | 8/1945 | Burckhardt et al. | |
| 2,656,889 A | | 8/1953 | Kaplan | |
| 3,116,718 A | | 1/1964 | Krupotich et al. | |
| 3,132,629 A | | 5/1964 | Krupotich et al. | |
| D202,673 S | | 10/1965 | Kamp | |
| D204,338 S | | 4/1966 | MacKrell | |
| D212,062 S | | 8/1968 | Davis | |
| 3,673,763 A | * | 7/1972 | Dorfmann | 53/558 |
| 3,828,634 A | | 8/1974 | Luperti | |
| 3,927,589 A | | 12/1975 | Emkjer et al. | |
| 3,943,807 A | | 3/1976 | Bingham et al. | |
| D260,133 S | | 8/1981 | Power et al. | |
| D263,276 S | | 3/1982 | Tagaki | |
| D272,229 S | | 1/1984 | Oussani | |
| 4,576,287 A | | 3/1986 | Bingham et al. | |
| 4,741,105 A | | 5/1988 | Wong | |
| 4,893,454 A | * | 1/1990 | Russell | 53/492 |
| 4,973,037 A | | 11/1990 | Holbrook | |
| 5,156,515 A | | 10/1992 | Charron et al. | |
| 5,336,034 A | | 8/1994 | Hidding | |
| 5,443,253 A | | 8/1995 | Dale et al. | |
| 5,470,182 A | | 11/1995 | Krupotich et al. | |
| 5,767,452 A | | 6/1998 | Yankloski | |
| 5,927,705 A | | 7/1999 | Becker et al. | |
| 6,196,393 B1 | * | 3/2001 | Kruk et al. | 209/630 |

FOREIGN PATENT DOCUMENTS

DE 2535889 1/1976

OTHER PUBLICATIONS

Omation Product Specification for Model 202c published before June 5, 1998.
Omation Product Specification for Model 106 published before Jun. 5, 1998.
Omation Product Specification for Model 2000 published before Jun. 5, 1998.
Omation Product Specification for Model EV–2 published before Jun. 5, 1998.

* cited by examiner

*Primary Examiner*—John Paradiso
(74) *Attorney, Agent, or Firm*—Stephen H. Eland; Dann, Dorfman, Herrell & Skillman, P.C.

(57) ABSTRACT

An apparatus is provided for processing mail by severing an edge of each envelope in a stack of mail. The apparatus includes an input bin for receiving a stack of mail. A feeder feeds the bottom envelope from the input bin to a transport that conveys the envelope along an envelope path. A cutter positioned along the envelope path severs one edge of the envelopes. A displaceable outfeed guide is provided for supporting the cut edge of the envelope as the envelop is being cut. Preferably, the outfeed guide is connected with the cutter so that the outfeed guide automatically adjusts position as the depth of cut is adjusted. The transport discharges the opened envelopes onto a return conveyor that conveys the opened envelopes to a stacking area where the opened envelopes are stacked.

24 Claims, 6 Drawing Sheets

APPARATUS FOR OPENING ENVELOPES

PRIORITY APPLICATION

The present application claims priority to U.S. Provisional Application No. 60/317,065, filed Sep. 4, 2001, which is hereby incorporated by reference.

FIELD OF THE INVENTION

The present invention relates to an apparatus for processing mail and, more specifically, to an apparatus for severing an edge of an envelope to facilitate removal of the contents from the envelope.

BACKGROUND OF THE INVENTION

Automated and semi-automated machines have been employed for processing mail. One such device is an envelope opener that is operable to sever an edge of each piece of mail being processed. A typical known envelope opener has an input bin for receiving a stack of mail, and a feeder for feeding the envelopes from the input bin to a conveyor that conveys the envelopes to a device that severs an edge of the envelopes.

In the known envelope openers, a gap is created adjacent the top edge of an envelope as the envelope is cut. The gap can cause an envelope to skew, resulting in an improperly cut edge. This is particularly true when the depth of cut is relatively deeper.

SUMMARY OF THE INVENTION

In light of the shortcomings of the existing devices, the present invention provides an envelope opening apparatus for efficiently processing mail. The apparatus includes an input bin for receiving a stack of envelopes. A feeder serially feeds the envelopes from the input bin to a transport which conveys the envelopes along an envelope path. A cutter positioned along the envelope path operates to sever one edge of each of the envelopes. An outfeed guide positioned adjacent the cutter guides the envelopes as they are conveyed away from the cutter. A controller is operable to vary the depth of cut of the cutter, wherein the cutter and the outfeed guide are operatively linked such that operating the controller to vary the depth of cut also displaces the outfeed guide.

DESCRIPTION OF THE DRAWINGS

The foregoing summary as well as the following detailed description of the preferred embodiment of the present invention will be better understood when read in conjunction with the appended drawings, in which.

DETAILED DESCRIPTION OF THE PREFERRED EMBODIMENT

Figure 1:
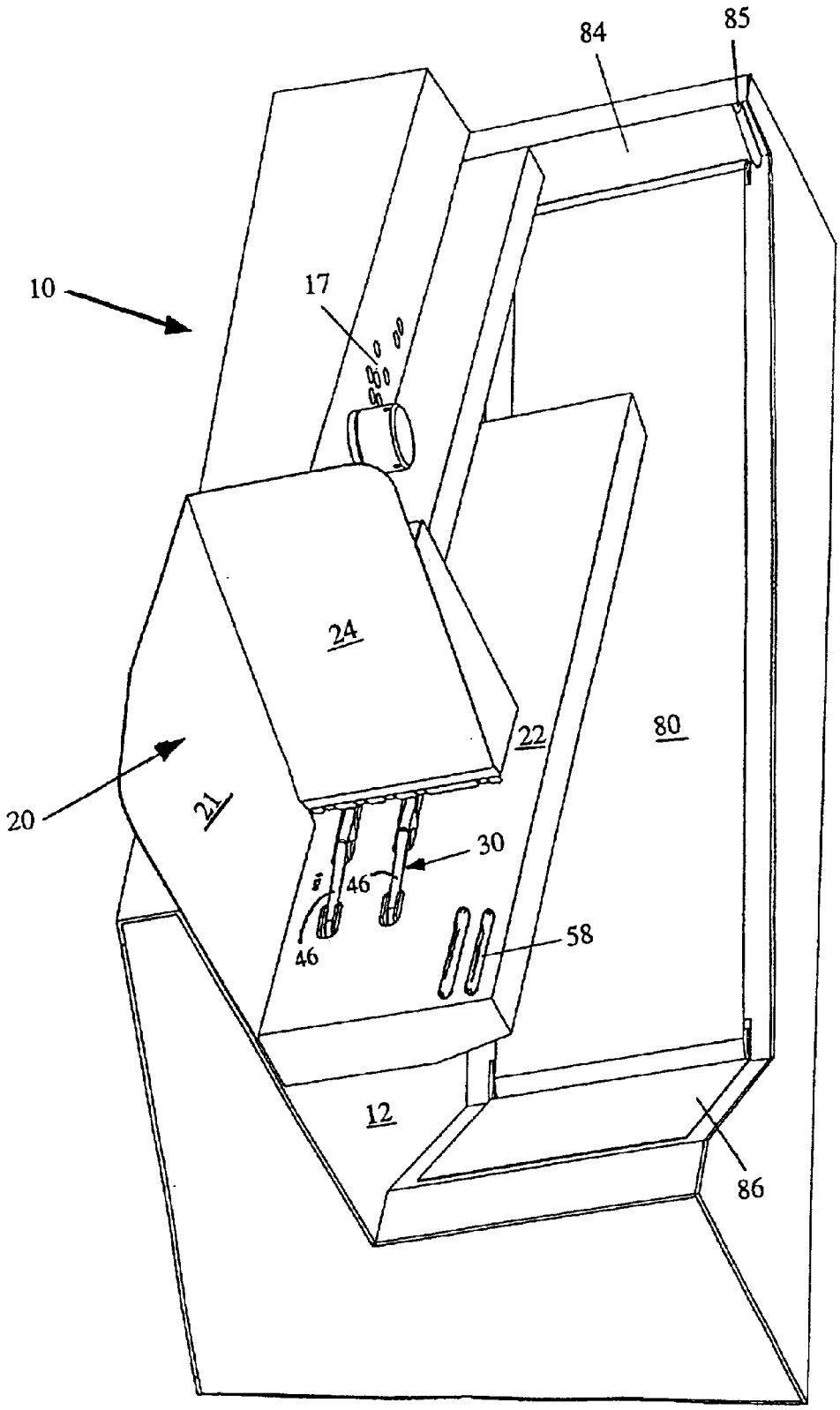
FIG. 1 is a perspective view of an apparatus for opening envelopes according to the present invention.
Figure 2:
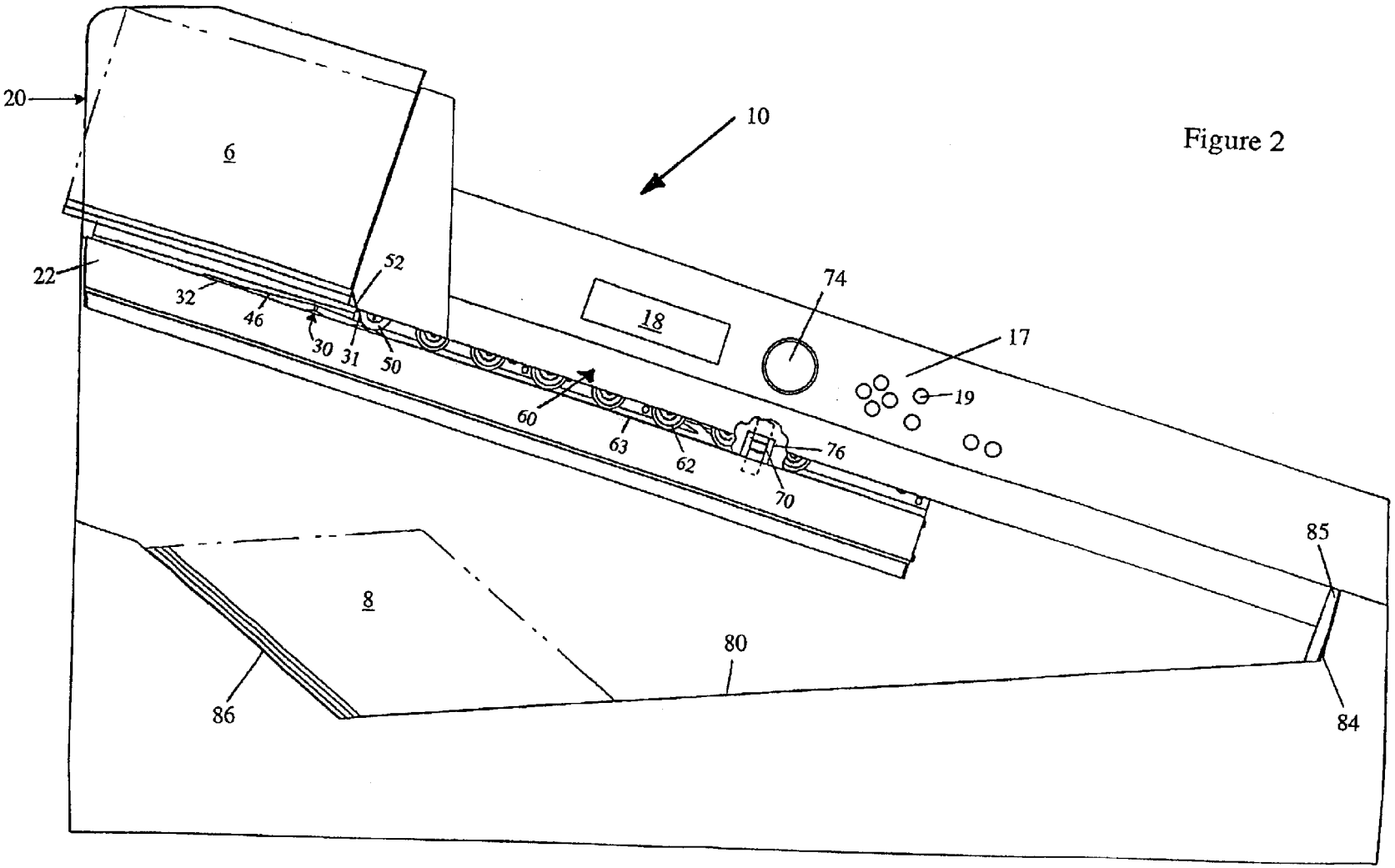
FIG. 2 is a front elevational view of the apparatus illustrated in FIG. 1.

Referring now to the drawings in general and to FIGS. 1 and 2 specifically, a device for opening envelopes is designated 10. The envelope opener 10 includes an input bin 20 for receiving a stack of unopened envelopes 6. A feeder 30 serially feeds the envelopes from the input bin 20 to an envelope transport 60, which conveys the envelopes along a path. A cutter assembly 70 positioned along the envelope path severs an edge of each envelope as the transport 60 conveys the envelopes. The transport 60 discharges the envelopes and the envelopes fall vertically onto the surface of a return conveyor 80. The return conveyor 80 conveys the envelopes to a stacking area, where the envelopes are reoriented from a generally horizontal orientation to form a stack of opened envelopes 8 in an inclined orientation. The vertically oriented envelopes accumulate on the return conveyor in a horizontal stack until they are manually removed by an operator. The operation of the device is controlled by a control panel 17 having an LCD output screen 18 and a plurality of buttons 19 for manually inputting various operational parameters, such as the number of envelopes to be processed before pausing to allow the operator to remove the stack of opened envelopes 8.

The device 10 is operable to open envelopes of various sizes, including standard-size envelopes, oversized envelopes, commonly referred to as flats, and other large envelopes such as cardboard overnight shipment letter packs. The various envelope sizes need not be sorted by size prior to processing. Instead, a stack of envelopes of similar or varying envelope-size can be processed together. The stack of envelopes 6 is placed into the input bin 20 so that the envelopes form a vertical stack of horizontally disposed envelopes.

The device 10 includes a generally vertical back plate 12. Referring to FIG. 1, preferably, the back plate 12 is angled from front to back approximately 15° from vertical.

The input bin 20 includes a rear wall 21 parallel to and attached to the back plate 12, a side wall 24 and a generally planar base plate 22 that also extends under the envelope transport 60. The base plate 22 is generally horizontal, projecting from the back plate substantially normal to the back plate being angled downwardly from left to right from the perspective of FIG. 2, approximately 17° from horizontal. Preferably, the stack of envelopes are edge justified along one of the edges of the stack and the justified edge of the stack is placed in the input bin 20 against the rear wall 21. In addition, the transport 60 is disposed at an angle toward the back plate 12, so that the transport justifies the envelopes against the back plate. Specifically, the transport is angled at 2½° angle relative to the back plate 12 so that the transport feeds the envelopes forwardly along the envelope path, and laterally toward the back plate.

The input bin 20 preferably includes a pair of ribs 58 protruding upwardly from the base plate 22. The ribs are only illustrated in FIG. 1. The ribs 58 are longitudinally elongated and are located adjacent the front edge of the base plate 22. Standard sized envelopes lie flat on the base plate 22 between the ribs 58 and the rear wall 21. The front edge of oversized mail engages the ribs 58 so that the front edge of an oversized envelope rests on the ribs, thereby further angling the oversized envelope toward the rear wall 21 to reduce the possibility of the envelope falling forward out of the input bin.

Referring to FIGS. 1 and 2, the feeder 30 feeds the envelopes from the input bin 20 to the transport 60 one at a time. The feeder 30 includes a pair of feed belts 46 that protrude through the base plate 22 in the input bin 20, confronting the bottom envelope of the stack of envelopes. The side wall 24 of the input bin terminates above the base plate 22, so that a feed slot 31 is formed between the base plate and the bottom edge of the side wall. It is desirable that the height of the feed slot 31 correspond to the thickness of the bottom envelope to reduce the possibility that the feeder will simultaneously feed two envelopes, a problem commonly referred to as a double feed. Accordingly, if the device is to be used to process mail having a variety of envelope thicknesses, it is desirable to have a variable height feed slot.

Referring again to FIG. 2, the feeder 30 feeds the envelopes to the transport 60, which conveys the envelopes past a cutter assembly 70. The transport comprises a plurality of rollers 62 in an aligned row opposing a transport belt. Each roller 62 is mounted on a pivotable arm positioned vertically above the transport belt 63. The transport 60 conveys the envelopes between the transport belt 63 and the rollers 62. Preferably, the transport belt 63 is disposed at a 2½° angle toward the back plate 12, similar to the feeder, so that the transport belt conveys the envelopes forwardly along the envelope path and laterally toward the back plate. Each roller arm is biased downwardly urging the corresponding roller 62 into contact with the transport belt 63. A cover 64 partially encloses the rollers to prevent the operator from inadvertently contacting the rollers 62 during operation of the device.

Figure 3:
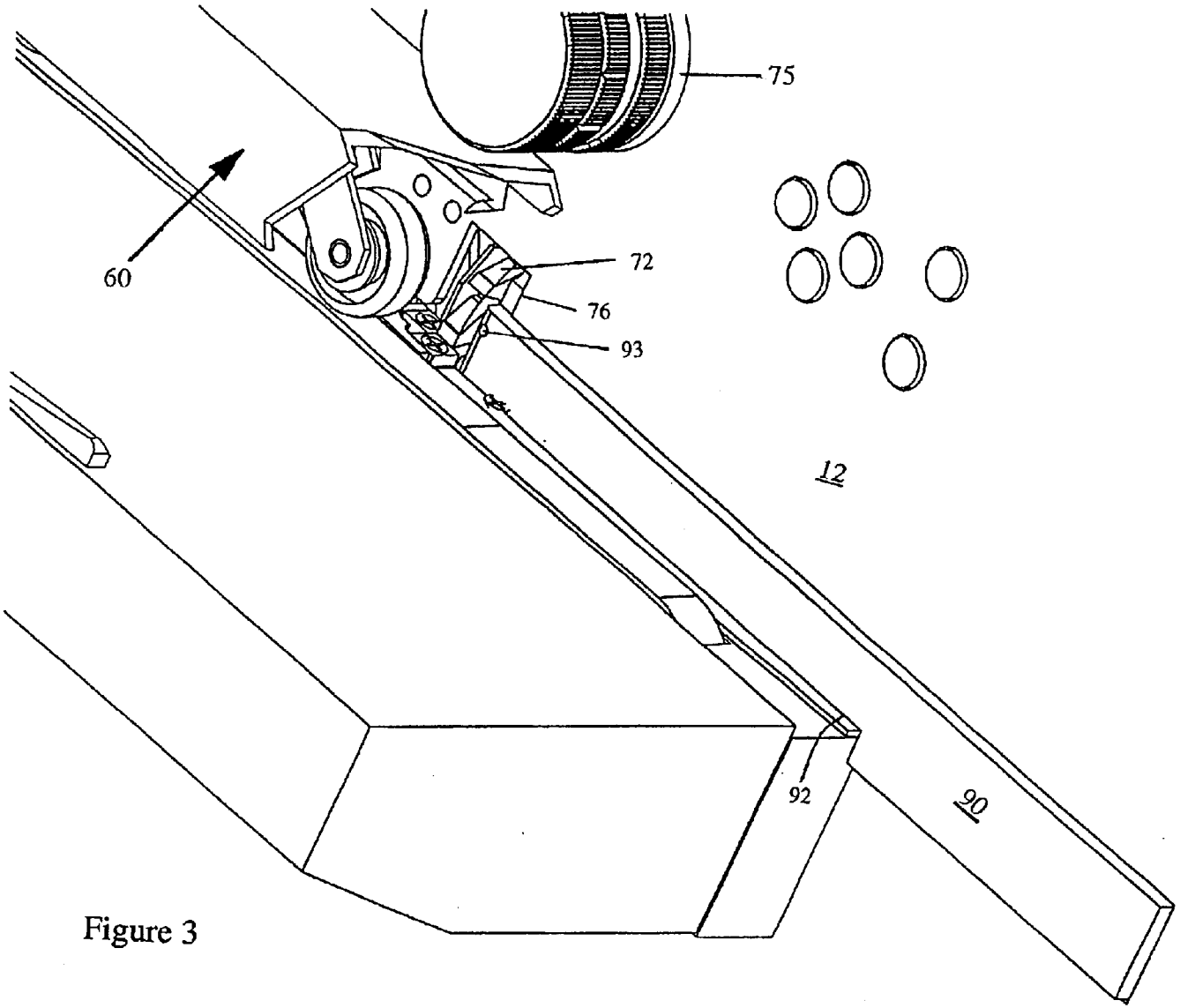
FIG. 3 is an enlarged fragmentary perspective partially broken away view of the apparatus illustrated in FIG. 1.

Referring now to FIG. 3, the cutter assembly 70 is positioned along the path of the transport 60, and it includes a circular milling cutter 72 housed within a housing 74 located behind the back plate 12. The cutter 72 protrudes through an opening 76 in the back plate 12 of the device and mills the edge of an envelope as the envelope is conveyed past the cutter. As discussed further below, the back plate operates as a guide, guiding the edge of the envelope to be cut as it approaches the cutter assembly 70. Preferably a moveable outfeed guide 90 is provided for guiding the cut edge of the envelope as the cut edge is displaced away from the cutter assembly 70.

The edge of each envelope conveyed by the transport is justified against the back plate 12. Therefore, the depth of cut of the cutter into the envelope is determined by the distance that the cutter protrudes from the back plate 12. Since the device is operable to open a variety of types of envelopes, the depth of cut can be varied to correspond to the type of envelopes being processed in a particular stack. The depth of cut is controlled by an adjustment knob 75 on the control panel.

More specifically, the housing 74 is pivotably attached to the back side of the back plate 12. Pivoting the housing 74 toward the back plate 12 pivots the cutter 72 forwardly, so that the cutter projects further out through the opening 76. The housing 74 is pivoted by turning the adjustment knob 75.

Figure 4:
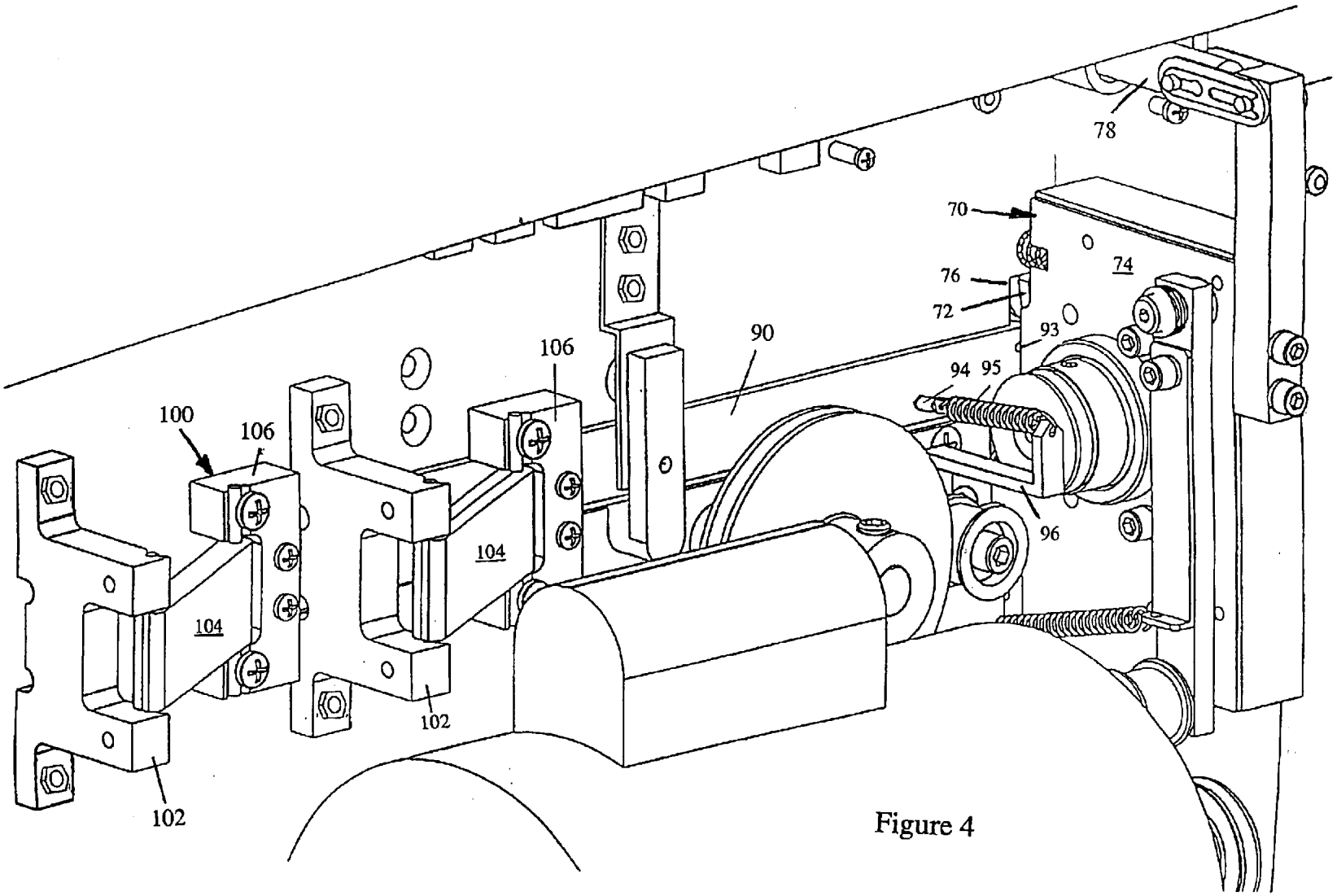
FIG. 4 is an enlarged fragmentary perspective broken away view, illustrating the details of a cutter assembly and outfeed guide of the apparatus illustrated in FIG. 1.

Referring to FIGS. 3 and 4, the adjustment knob 75 preferably includes a camming surface, such as a helical cam groove, that cooperates with a connecting rod 78 attached to the cutter housing 74. The connecting rod has an end that engages the camming surface and operates as a follower. More specifically, the connecting rod 78 is attached to a post extending from the cutter housing 74. The connecting rod is constrained to translational motion so that as the knob is rotated, the camming surface cooperates with the connecting rod 78 to convert the rotational motion into translation motion, which in turn pivots the cutter assembly 70. In this way, turning the knob one way pivots the cutter outwardly to increase the depth of cut. Turning the knob 75 in the opposite direction pivots the cutter inwardly to decrease the depth of cut.

Preferably, the camming surface in the knob 75 has several recesses spaced apart along the length of the camming surface. The recesses correspond to preset depth of cut positions for the cutter assembly 70. In addition, preferably a fine adjustment is provided for making fine adjustments to the depth of cut. Specifically, preferably the knob has a threaded engagement with the back plate 12, such the knob can be screwed toward or away from the back plate, thereby altering the position of the camming surface in the knob relative to the back plate, which in turn alters the depth of cut.

As an envelope approaches the cutter 72, the transport 60 justifies the top edge of the envelope against the back plate 12. As the envelope passes by the cutter 72, the cutter cuts away a portion of the edge of the envelope, which creates a gap above the forward portion of the cut edge of the envelope as it is being cut. Since the transport 60 justifies the envelopes against the back plate as they are being cut, the leading edge of an envelope may skew inwardly toward the back plate as the envelope is being cut, so that the trailing portion of the cut edge may not be properly cut in some instances. Accordingly, preferably, the apparatus 10 includes a moveable outfeed guide 90 for guiding and supporting the leading portion of the cut edge of an envelope as the envelope is being cut.

Figure 6:
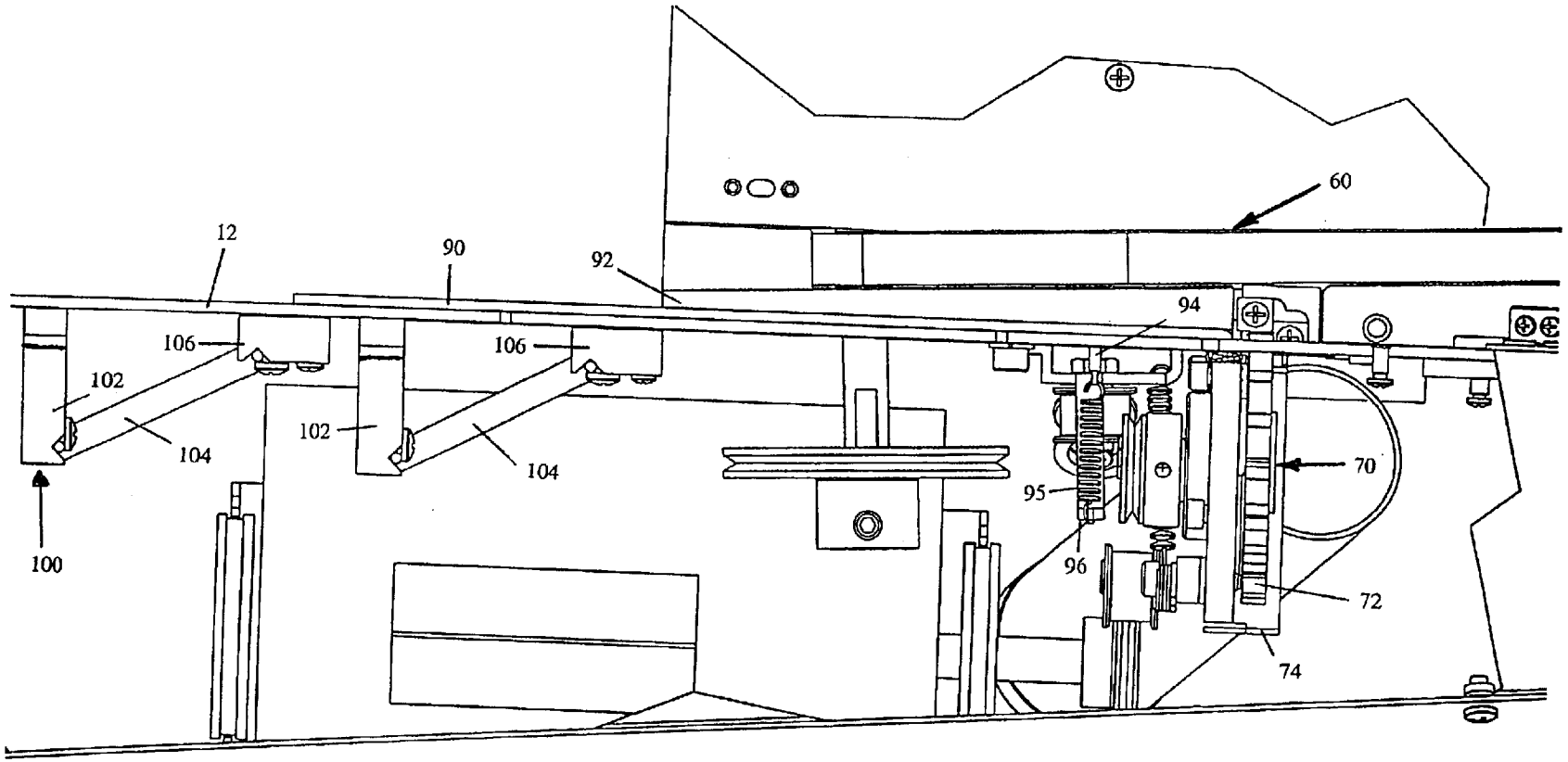
FIG. 6 is an enlarged fragmentary top view partially broken away of the apparatus illustrated in FIG. 5, illustrating the outfeed guide in an extended position.

As shown in FIGS. 3 and 6, the outfeed guide 90 projects outwardly from the back plate 12 so that the outfeed guide supports the cut edge of the envelope as it is being cut. Preferably, the outfeed guide 90 projects outwardly from the back plate a distance substantially equal to the depth of cut of the cutter 72.

Figure 5:
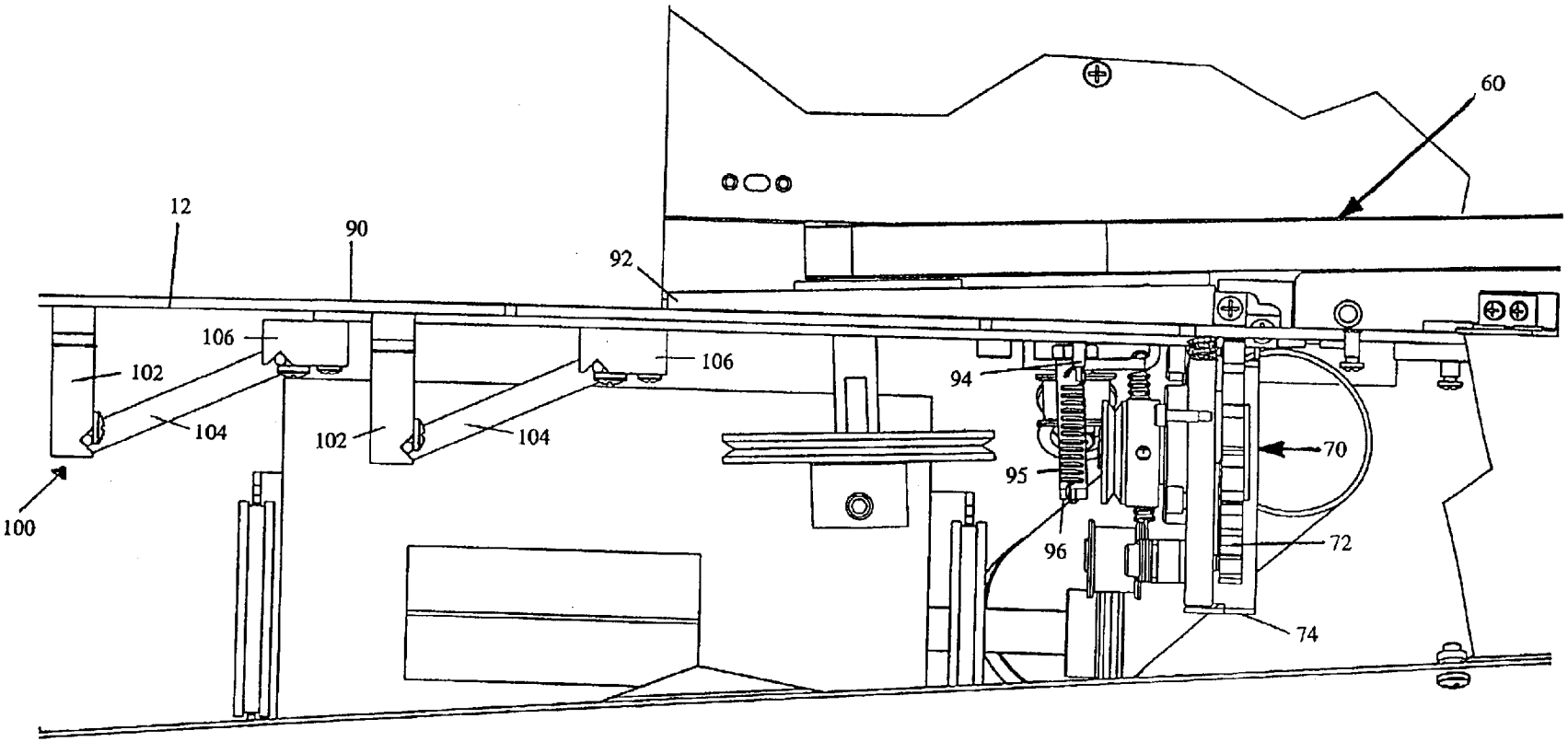
FIG. 5 is an enlarged fragmentary top view partially broken away of the apparatus illustrated in FIG. 4, illustrating the outfeed guide in a retracted position.

The outfeed guide 90 is a substantially elongated planar element that is displaceable inwardly and outwardly from the back plate, laterally with respect to the direction of travel of the envelopes. The outfeed guide can be retracted inwardly, as shown in FIG. 5 so that the guide is flush with the plane of the back plate 12. In FIG. 6, the outfeed guide is illustrated fully extended, which preferably is approximately 3/16". However, the maximum extension of the outfeed guide can be increased or decreased if desired.

Preferably, the outfeed guide 90 is operatively connected with the cutter assembly 70 so that the outfeed guide moves inwardly and outwardly automatically as the depth of cut of the cutter is adjusted. The outfeed guide 90 may be fixedly connected to the cutter assembly 70. However, as shown in FIG. 4, preferably the outfeed guide is biased into engagement with the cutter housing 74.

A spring arm 96 fixedly attached to the back side of the back plate 12 projects rearwardly away from the outfeed guide 90. A post 94 attached to the outfeed guide also projects rearwardly. A spring 95 connected to the post 94 and the arm 96 biases the outfeed guide rearwardly against the cutter housing. In this way, as the depth of cut is increased, the cutter housing 74 pivots toward the back plate, pushing the outfeed guide 90 outwardly. As the depth of cut is decreased, the cutter housing 74 pivots away from the back plate, and the spring 95 pulls the outfeed guide inwardly up against the cutter housing. Therefore, the outfeed guide 90 automatically adjusts to changes in the depth of cut.

The back side of the outfeed guide 90 may directly contact the face of the cutter housing 74. However, preferably, a pin or set screw 93 projects rearwardly from the outfeed guide, providing a point of contact with the cutter housing. The set screw can be threaded inwardly or outwardly to adjust the position of the outfeed guide relative to the cutter 72.

Since the outfeed guide 90 is elongated, it is desirable to provide a position guide 100 to maintain the outfeed guide in parallel relation with the back plate 12. Otherwise, the outfeed guide 90 could skew relative to the back plate, which could allow the envelopes to skew as they are cut, which in turn could lead to improper edge cuts.

In the present instance, the position guide 100 is a parallel linkage that is provided to maintain the outfeed guide parallel to the back plate 12. The parallel linkage 100 comprises a pair of posts 104 fixedly attached to the back side of the back plate 12. A pair of connecting blocks 106 are fixedly attached to the outfeed guide 90. A pair of connecting arms 104 are pivotably attached to the posts 102 and the connecting blocks 106. The arms 104 are the same length, so that the arms constrain the outfeed guide 90 to movement parallel to the plane of the back plate 12.

As described above, the outfeed guide 90 is displaceable through an opening in the back plate 12. To facilitate such movement, there is a clearance gap between the outfeed guide and the opening in the back plate. However, since the transport 60 urges the envelopes toward the back plate and the outfeed guide, it is possible for the envelope to get jammed in the gap between the outfeed guide and the back plate. Accordingly, it is desirable to have an edge support 92 attached to the lower edge of the outfeed guide.

The edge support 92 extends along the substantially the length of the outfeed guide, and projects transverse the outfeed guide. The edge guide 92 is substantially parallel to the surface of the base plate 22 of the transport 60, so that the edge guide supports the bottom face of the envelope along the edge being cut.

The intersection of the edge support 92 and the outfeed guide forms a corner. The transport 60 justifies the envelopes into this corner as the envelopes are being cut, thereby preventing the envelopes from becoming jammed in the gap between the back plate 12 and the outfeed guide 90.

After the envelopes are cut, the transport discharges the opened envelopes onto the lower transport 80. As shown in FIG. 2, the transport 60 and the return conveyor 80 vertically overlap. The base plate 22 of the transport 60 terminates intermediate the return conveyor, so that a discharge gap is provided between the end of the transport and the right-most end of the conveyor 80. The discharge gap width is wider than the length of the longest envelope to be processed by the device. In this way, the envelopes exiting the transport 60 fall vertically onto the return conveyor.

The return conveyor 80 comprises a conveyor belt having a width that is wide enough to support and convey the envelopes. Preferably the return conveyor is angled downwardly from right to left approximately 6° from horizontal, and is angled downwardly from front to back approximately 15° from horizontal.

The conveyor 80 is disposed between a right end wall 84 that protrudes above the uppermost edge of the return conveyor, and a left end wall 86 adjacent the end of the return conveyor. The right end wall 84 operates as a stop, stopping the forward motion of the envelopes as they are discharged from the transport 60. Specifically, as an envelope is discharged from the transport 60, the envelopes is moving downwardly and forwardly from left to right from the perspective of FIG. 2. After the envelope contacts the return conveyor, the forward motion of the envelope continues to propel the envelope to the right. The right end wall 84 limits the forward motion of the envelope, preventing the envelope from being propelled off the end of the return conveyor. Preferably a resilient vertical rib 85 is attached to the forward edge of the right end wall 84 so that oversized envelopes impacting the right wall are urged toward the back plate 12, thereby reducing the possibility that an oversized envelope will inadvertently fall off the return conveyor after impacting the right wall. In addition, preferably, a compressible layer, such as foam, may be attached to the right wall to limit the rebound of the envelopes as they hit the right wall.

The envelopes are discharged onto the return conveyor 80 so that a face of each envelope lies on the return conveyor. The return conveyor 80 conveys the envelopes toward the left end wall 86 that is at an angle to the return conveyor. As the leading edge of the first envelope in a stack being processed contacts the left wall 86, the return conveyor 80 drives the envelope up the left wall, thereby reorienting the envelope from a generally horizontal orientation to an inclined orientation. The return conveyor then conveys the next succeeding envelope into contact with the first envelope so that the envelope is driven up a face of the first envelope until the envelope is oriented similarly to the first envelope. In this way, the processed envelopes form a generally horizontal stack of envelopes resting on edge on the return conveyor. The stacked envelopes are then manually removed by an operator.

It will be recognized by those skilled in the art that changes or modifications may be made without departing from the broad inventive concepts of the invention. For instance, the device has been described as including a parallel linkage for retaining the outfeed guide 90 parallel to the base plate as it is displaced. However, other types of elements can be used to achieve this function. For instance, a pair of guide pins could be attached to the outfeed guide 90. The pins could cooperate with a pair of parallel slots, which limit the guide to parallel movement. Further, the device has been described as including a spring that biases the outfeed guide 90 toward the cutter assembly 70 to maintain the two in operative engagement. Alternatively, the outfeed guide 90 and cutter assembly 70 can be more directly connected, such as by a universal ball and joint connection. It should therefore be understood that this invention is not limited to the particular embodiments described herein, but is intended to include all changes and modifications that are within the scope and spirit of the invention as set forth in the claims.

That which is claimed is:

1. An apparatus for opening envelopes, comprising:

an input bin for receiving a stack of envelopes;

a cutter operable to open an edge of each of the envelopes;

a displaceable outfeed guide positioned adjacent the cutter to guide the envelopes as the envelopes are conveyed away from the cutter;

a controller operable to vary the depth of cut of the cutter, wherein the controller is operatively linked with the outfeed guide such that operating the controller to vary the depth of cut automatically displaces the outfeed guide.

2. The apparatus of claim 1 wherein operating the controller to vary the depth of cut to a new depth of cut automatically displaces the outfeed guide to a position correlating to the new depth of cut.

3. The apparatus of claim 1 comprising a biasing element biasing the outfeed guide toward the cutter.

4. The apparatus of claim 1 comprising a justifier for justifying the envelopes against the outfeed guide as the cutter opens the envelopes.

5. The apparatus of claim 1 comprising an adjustment element for adjusting the position of the outfeed guide relative to the cutter.

6. The apparatus of claim 1 comprising a edge guide extending transverse the outfeed guide to support a lower edge of the envelopes, wherein the edge guide is attached to the outfeed guide.

7. The apparatus of claim 1 wherein the controller comprises a plurality of pre-set stops corresponding to pre-set depth of cut positions.

8. The apparatus of claim 1 comprising means for maintaining the angular position of the outfeed guide relative to the cutter as the outfeed guide is displaced.

9. An apparatus for opening envelopes, comprising:

an input bin for receiving a stack of envelopes;

a cutter operable to open an edge of each of the envelopes;

a displaceable outfeed guide positioned adjacent the cutter to guide the envelopes as the envelopes are conveyed away from the cutter;

a controller operable to vary the depth of cut of the cutter;

a connector operatively linking the cutter and the outfeed guide such that operating the controller to vary the depth of cut also displaces the outfeed guide.

10. The apparatus of claim 9 wherein the connector comprises a biasing element biasing the outfeed guide toward the cutter.

11. The apparatus of claim 9 comprising a justifier for justifying the envelopes against the outfeed guide as the cutter opens the envelopes.

12. The apparatus of claim 9 comprising an adjustment element for adjusting the position of the outfeed guide relative to the cutter.

13. The apparatus of claim 9 comprising a edge guide extending transverse the outfeed guide to support a lower edge of the envelopes wherein the edge guide is attached to the outfeed guide.

14. The apparatus of claim 9 wherein the controller comprises a plurality of pre-set stops corresponding to pre-set depth of cut positions.

15. The apparatus of claim 9 comprising means for maintaining the angular position of the outfeed guide relative to the cutter as the outfeed guide is displaced.

16. An apparatus for opening envelopes, comprising:

an input bin for receiving a stack of envelopes;

a transport for conveying the envelopes along an envelope path;

a feeder for serially feeding the envelopes from the input bin to the transport;

a cutter positioned along the envelope path operable to sever one edge of each of the envelopes;

an infeed guide positioned adjacent the cutter to guide the envelopes as they are conveyed to the cutter;

an outfeed guide positioned adjacent the cutter to guide the envelopes as they are conveyed away from the cutter;

a controller operable to vary the depth of cut of the cutter;

wherein the cutter and the outfeed guide are operatively linked such that operating the controller to vary the depth of cut also displaces the outfeed guide.

17. The apparatus of claim 16 wherein the cutter is pivotable relative to the infeed guide, and the controller is operable to pivot the cutter relative to the infeed guide to vary the depth of cut.

18. The apparatus of claim 16 comprising means for maintaining the outfeed guide parallel to the infeed guide when the outfeed guide is displaced.

19. The apparatus of claim 16 comprising a pair of guide arms pivotably attached to the outfeed guide operable to maintain the outfeed guide parallel to the infeed guide when the outfeed guide is displaced.

20. The apparatus of claim 16 comprising an edge guide extending transverse the outfeed guide to support a lower edge of the envelopes, wherein the edge guide is attached to the outfeed guide.

21. The apparatus of claim 16 wherein the transport is operable to convey the envelopes toward the infeed guide and the outfeed guide.

22. The apparatus of claim 16 wherein the cutter comprises a milling cutter and an anvil assembly, wherein the anvil supports an edge of the envelope as the cutter cuts the edge of the envelope.

23. The apparatus of claim 22 comprising an opening between the infeed guide and the outfeed guide, wherein the anvil and milling cutter project outwardly through the opening and into the envelope path.

24. The apparatus of claim 16 comprising a biasing element biasing the outfeed guide toward the cutter.

* * * * *